US006016931A

United States Patent [19]

Ohmi et al.

[11] Patent Number: 6,016,931

[45] **Date of Patent: *Jan. 25, 2000**

[54] CAP SEPARABLE FROM BOTTLE AT THE TIME OF DISPOSAL

[75] Inventors: Hidehiko Ohmi; Tateo Kubo; Mitsuo Kumata, all of Hiratsuka, Japan

[73] Assignee: Japan Crown Cork Co., Ltd, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/764,406

[22] Filed: Dec. 11, 1996

[30] Foreign Application Priority Data

Aug. 23, 1996 [JP] Japan ..... 8-222018

[51] Int. Cl.[7] ..... B65D 41/34; B65D 41/62

[52] U.S. Cl. ..... 215/256; 215/204; 215/305

[58] Field of Search ..... 215/256, 250, 215/254, 272, 274, 204, 211, 213, 214, 216, 271–219, 220, 221, 251–253, 258, 273–275, 298, 305, 329, 330, 341, 343, 347; 220/254, 265, 270, 276

[56] References Cited

U.S. PATENT DOCUMENTS

| | | | |
|---|---|---|---|
| 4,076,140 | 2/1978 | Perne | 215/256 |
| 4,371,089 | 2/1983 | Barendregt | 215/256 |
| 4,760,941 | 8/1988 | Salmon et al. | 215/256 X |
| 4,948,003 | 8/1990 | Munoz . | |
| 5,054,633 | 10/1991 | Reijenga | 215/251 X |
| 5,085,332 | 2/1992 | Gettig et al. | 215/274 X |
| 5,246,124 | 9/1993 | Battegazzore | 215/251 |
| 5,316,136 | 5/1994 | Von Schuckmann | 215/274 X |

FOREIGN PATENT DOCUMENTS

| | | |
|---|---|---|
| 2 480 245 | 10/1981 | France . |
| 2 565 208 | 6/1985 | France . |
| 06 059 247 U | 8/1994 | Japan . |
| 07 009 751 U | 2/1995 | Japan . |

*Primary Examiner*—Stephen Castellano
*Assistant Examiner*—Niki M. Eloshway
*Attorney, Agent, or Firm*—Fulbright & Jaworski, L.L.P.

[57] ABSTRACT

A cap comprises a cap body fitted and secured to the mouth of a container, an upper closure provided in the cap body, and a ring-like member which covers the outer surface of a skirt portion of the cap body. The ring-like member and the skirt portion are coupled together through breakable bridge portions. These two members are separated away from each other via cut surfaces but are intimately contacted to each other at the cut surfaces. The cap can be easily removed by hand from the mouth of the container, and can be separated from the container at the time of disposal.

12 Claims, 5 Drawing Sheets

CAP SEPARABLE FROM BOTTLE AT THE TIME OF DISPOSAL

BACKGROUND OF THE INVENTION

1. Field of the Invention

The present invention relates to a cap separable from bottle at the time of disposal. More specifically, the invention relates to a cap that is strongly fitted and secured to the mouth of a container but that can be easily removed from the mouth of the container without using any special tool, and that offers excellent sealing and tamper-evidence.

2. Description of the Prior Art

Plastic caps have an excellent moldability, exhibit excellent flexibility and can, hence, be strongly fitted and secured to the mouths of containers by the capping operation to maintain high degree of sealing.

In many cases, however, the plastic caps are used for a glass bottle or the plastic containers made of materials different from the cap materials. To meet the demands for reusing the resources and for separating the cap from the bottle at the time of disposal, it has been desired to easily remove the caps from the mouths of the containers without using a tool such as cutter or the like.

There have been proposed a variety of caps separable from bottle at the time of disposal. For example, Japanese Utility Model Laid-Open No. 59247/1994 discloses a container closure comprising a cap body fitted and secured to the mouth of a container, a cylinder screwed to the cap body, and an overcap coupled by hinges to the cylinder. In the container closure, the cap body comprises a top plate portion having a breaking portion for forming a flow-out port, a side wall coupled integrally to the peripheral edge of the top plate, and an inner ring that downwardly extends from the inner surface of the top plate portion maintaining a suitable gap from the side wall. That is, the cap body is secured to the mouth of the container as the mouth of the container is fitted to between the side wall and the inner ring. Besides, the side wall is formed being broadened toward the back thereof or has a plurality of slits formed maintaining a suitable distance in the circumferential direction and extending in the direction of height, so that the cap body can be removed from the mouth of the container without using any special tool. Furthermore, a screw thread is formed on the upper outer peripheral surface of the side wall to hold the cylinder. When the cylinder is engaged with, and held by, the side wall, the side wall is pushed by the cylinder and is firmly held by the mouth of the container to maintain good sealing.

According to the container closure of the above prior art, the cylinder formed integrally with the overcap is turned, so that the cap body is removed from the side wall. Thus, the cap body can be easily removed by hand from the mouth of the container and can, hence, beseparated easily from the container at the time of disposal. However, this container closure does not offer tamper-evidence. That is, the container closure is removed by breaking neither the cylinder formed integrally with the cap nor the cap body. Therefore, even if the container closure that was once removed from the mouth of the container is fitted again to the mouth of the container, this fact cannot at all be recognized by a third person.

In order to produce the above-mentioned container closure, furthermore, the cylinder formed integrally with the overcap and the cap body must be formed respectively, and the two must then be combined together, leaving a problem of low productivity.

Furthermore, Japanese Utility Model Laid-Open No. 9751/1995 discloses a container closure comprising an inner plug fitted and secured to the mouth of the container, an outer cylinder and an overcap. Like the cap body mentioned above, the inner plug of the container closure has, formed in the top plate portion thereof, a breaking portion for forming a flow-out port, and permits the mouth of the container to be fitted between the side wall and the inner ring. Moreover, the top plate portion has an annular erected portion that is so formed as to surround the breaking portion, and the overcap is fitted being screwed about the outer surface of the erected portion. The outer cylinder is so provided as to surround the outer peripheral surface of the side wall of the inner plug, the outer cylinder and the side wall of the inner plug are formed integrally via a weakened portion, and a reinforcing ring is fitted in space between the inner surface of the outer cylinder and the outer surface of the side wall. That is, in a state where the container closure is fitted to the mouth of the container, the side wall of the inner plug is pushed onto the wall of the mouth of the container by the reinforcing ring, whereby the inner plug is firmly secured to the mouth of the container to maintain good sealing. The outer cylinder can be easily torn away from the inner plug by breaking the weakened portion. With the outer cylinder being torn away from the inner plug, the side wall is no longer pushed by the reinforcing ring. Therefore, the inner plug can be removed from the mouth of the container without using any special tool. As described above, this container closure can be separated easily from the container at the time of disposal. Besides, the container closure offers tamper-evidence since the inner plug is removed from the mouth of the container after the outer cylinder is turn away from the inner plug.

According to the container closure of the above-mentioned Japanese Utility Model Laid-Open No. 9751/1995, however, the side wall is pushed to the wall of the mouth of the container by the reinforcing ring. It is therefore necessary to form a thin portion in the side wall so that the side wall can be easily deflected. Therefore, the thin portion of the side wall is often broken when the inner plug is capped to the mouth of the container. Besides, the container closure has a triple-wall structure consisting of inner ring, side wall and outer cylinder. In addition, the reinforcing ring must be fitted between the side wall and the outer cylinder. Accordingly, the container closure is not easily molded, and there remains a problem that the reinforcing ring falls down prior to effecting the capping operation.

SUMMARY OF THE INVENTION

It is therefore an object of the present invention to provide a cap which is free from the defects of the above-mentioned conventional container closures, and can be easily separated from a bottle at the time of disposal, easily molded and produced, and is effectively prevented from being broken at the time of capping.

Another object of the present invention is to provide a cap which offers excellent tamper-evidence.

According to the present invention, there is provided a cap comprising:

a cap body including a top plate portion having a port for pouring out the content or a portion for forming the port and a skirt portion, the skirt portion having a protrusion formed on the inner surface thereof to engage with the mouth of a container;

a ring-like member formed integrally with the cap body so as to cover the outer surface of the skirt portion of the cap body; and an upper closure for covering the top plate portion of the cap body;

wherein the skirt portion of the cap body and the ring-like member are connected through a plurality of breakable bridge portions that are spaced in the circumferential direction, and the skirt portion of the cap body and the ring-like member are separated away from each other via cut surfaces but are intimately contacted to each other at the cut surfaces.

In the cap of the present invention, the upper closure is provided in the cap body relying upon a screw engagement or being coupled by hinges.

When the screw engagement is employed, it is desired that the upper closure is held by a member such as a pour-out nozzle that is so formed as to surround the pour-out port or a portion for forming the pour-out port of the top plate portion. When the coupling by hinges is employed, it is desired that the upper closure is coupled by hinges to the peripheral edge of the top plate portion of the cap body, so that the cap body and the upper closure are formed integrally.

According to the present invention, it is very important that the skirt portion of the cap body and the ring-like member are formed as a unitary structure through breakable bridge portions, and that the two are separated away from each other via cut surfaces but are intimately contacted to each other at the cutting surfaces. That is, when the cap of the present invention is fitted to the mouth of the container, the skirt portion of the cap body is intimately contacted to the ring-like member at the cutting surfaces and is fastened by the ring-like portion. Therefore, the skirt portion of the cap body is intimately contacted to the mouth of the container and is firmly secured to maintain good sealing. To remove the cap fitted to the mouth of the container, the ring-like member is pushed down or pulled up by hand to break the bridge portions, and the ring-like member is removed from the skirt portion of the cap body. Thus, the skirt portion is liberated from the state of being fastened by the ring-like member, and the cap body is easily removed from the mouth of the container by hand without using any special tool.

As described above, the cap of the present invention exhibits excellent sealing and can be separated from the container at the time of disposal. Besides, to remove the cap from the mouth of the container, the ring-like member must be removed from the skirt portion of the cap body. Therefore, even if the cap that is once removed from the mouth of the container is fitted again to the mouth of the container, a third person recognizes the fact that the cap was once removed since the ring-like member has been removed. It will thus be understood that the cap of the present invention offers tamper-evidence, if the cap has a portion for forming the opening where the content can be poured out.

According to the present invention, the above-mentioned bridge portions and the cut surfaces can be easily formed by cutting. That is, the cap body and the ring-like member are molded using a plastic material as a unitary structure relying upon injection molding, compression molding or the like method. Then, the bridge portions and the cut surfaces are formed by cutting predetermined portions of the molded article, i.e., by cutting a boundary portion between the skirt portion of the cap body and the ring-like member by using a cutter or the like but leaving the bridge portions. Therefore, when the boundary portion is cut by the cutter or the like from the upper direction, bridge portions are formed at the lower ends of the cut surfaces. When the boundary portion is cut from the lower direction, bridge portions are formed at the upper ends of the cut surfaces. When the upper closure is coupled by hinges to the cap body, the cutting is effected from the lower direction. This is because, the cutting cannot be effected from the upper direction being hindered by the upper closure.

The thus formed bridge portions are protected by the ring-like member. Therefore, even when the cap body is fitted to the mouth of the container by the capping operation, the bridge portions are effectively prevented from being broken.

In the present invention, furthermore, the skirt portion of the cap body and the ring-like member can be coupled together through the bridge portions and a coupling portion that cannot be broken. In this case, the ring-like member and the cap body can be removed integrally from the mouth of the container.

To smoothly remove the cap body from the mouth of the container in a state where the ring-like member has been removed, furthermore, it is desired to form a plurality of slits in the skirt portion of the cap body. These slits are extending in the axial direction and are spaced in the circumferential direction.

To more easily remove the ring-like member, furthermore, it is desired that the ring-like member is provided with a tab for unsealing. It is also allowable to form a weakened portion such as score in the ring-like member. Upon tearing the ring-like member away by breaking the weakened portion, the bridge portions can be very easily broken.

PREFERRED EMBODIMENTS OF THE INVENTION

Figure 1:
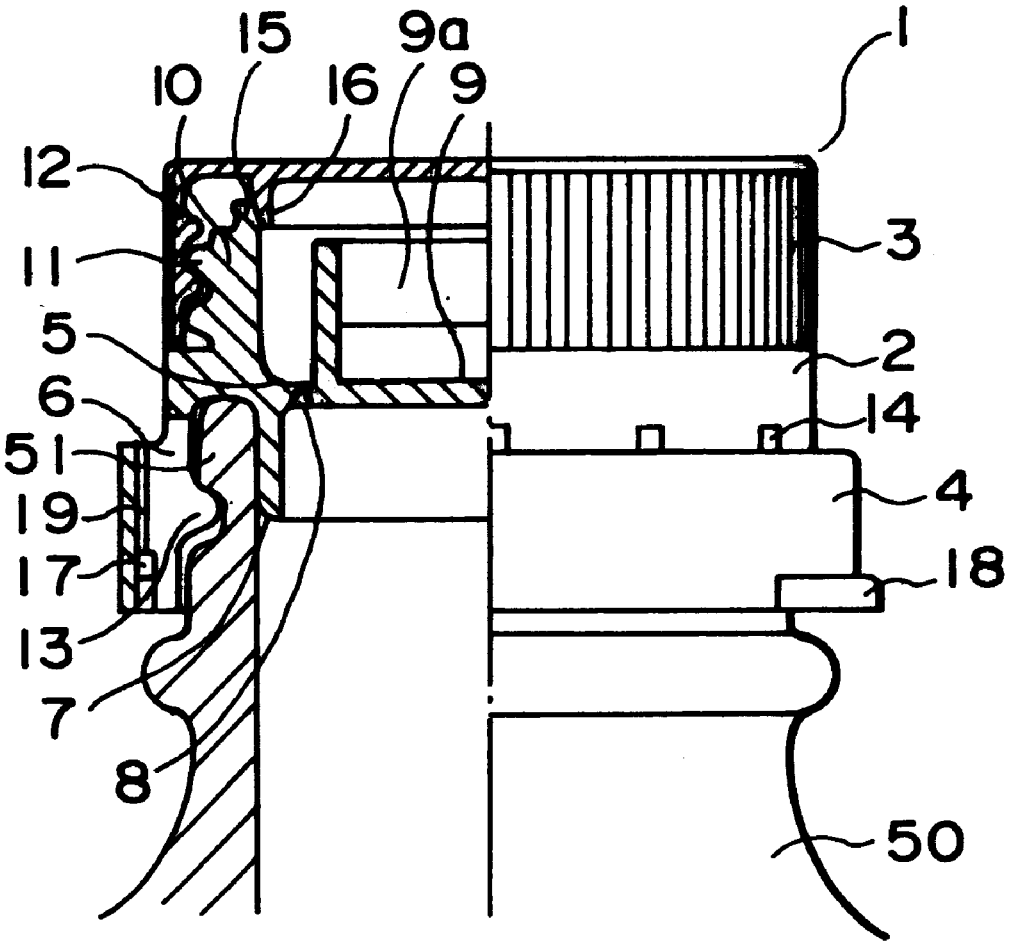
FIG. 1 is a side view illustrating, half in cross section, a cap according to an embodiment of the present invention.

Referring to FIG. 1, a cap of the present invention as a whole is denoted by 1. The cap 1 comprises a cap body 2, an upper closure 3 and a ring-like member 4.

The cap body 2 is formed of a top plate portion 5 and a skirt portion 6. The top plate portion 5 has a portion 9 sectionalized by a score 8 and where a pour-out port will be formed. The portion 9 for forming the port has a pull ring 9*a* for tearing the score 8. By pulling up the pull ring 9*a* by hand, the score 8 is torn, an opening is formed in the portion 9, and the content can be poured out. An inner ring 7 is formed on the lower surface side of the top plate portion 5, and a mouth 50 of a container is fitted to between the inner ring 7 and the skirt portion 6. On the upper surface of the top plate portion 5 is formed a pour-out nozzle 10 surrounding the portion 9, and the content is poured out being guided by the nozzle 10. A screw thread 11 is formed on the outer surface of the pour-out nozzle 10, and the upper closure 3 is detachably fitted to the cap body 2 by utilizing the screw thread 11.

A protrusion 13 is formed on the inner surface of the skirt portion 6 of the cap body, and the cap body 2 is secured to the mouth 50 of the container as the protrusion 13 is brought into engagement with a bead 51 formed on the mouth 50 of the container.

A screw thread 12 is formed on the inner surface of the upper closure 3, and the upper closure 3 is provided on the cap body 2 as the screw thread 12 is brought into screwed engagement with the screw thread 11 formed on the outer surface of the nozzle 10. Furthermore, an annular protrusion 16 is formed on the inner surface of the upper closure 3 and comes into intimate contact with the upper end 15 of the pour-out nozzle 10 to maintain the sealing when the port is formed in the portion 9.

According to the present invention, the ring-like member 4 is so provided as to cover the outer surface of the skirt portion 6 of the cap body 2. The ring-like member 4 is formed integrally with the skirt portion 6 via breakable bridge portions 17. Furthermore, the ring-like member 4 and the skirt portion 6 are separated from each other by cut surfaces 19 but are intimately contacted to each other at the cut surfaces 19. Therefore, the skirt portion 6 is tightened by the member 4 about the mouth 50 of the container and is secured thereto, so that the cap body 2 cannot be removed from the mouth 50 of the container.

The ring-like member 4 has a tab 18 for unsealing. Upon pulling up or pushing down the ring-like member 4 by grabbing the tab 18 by hand, the bridge portions 17 are broken and the ring-like member 4 can be removed.

Figure 2:
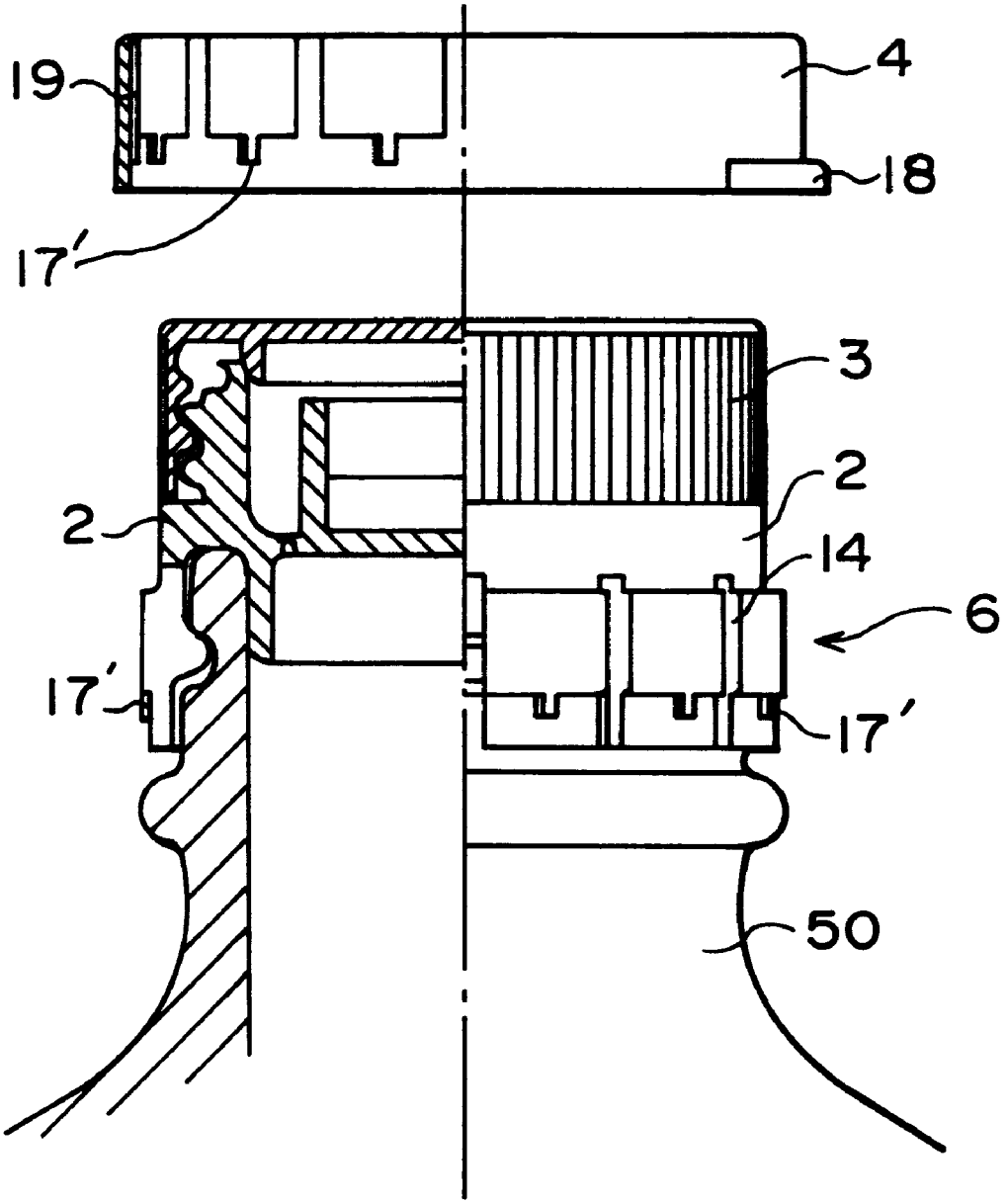
FIG. 2 is a side view illustrating, half in cross section, a state where a ring-like member is removed from the cap of FIG. 1.

FIG. 2 illustrates the cap from which the ring-like member 4 is removed, and the ring-like member 4 that is removed. In FIG. 2, the remaining portions of the bridge portions 17 after broken are designated at 17'. As the ring-like member 4 is removed as shown in FIG. 2, the skirt portion 6 is no longer tightened and can be easily expanded outwards, permitting the cap body 2 to be removed by hand from the mouth 50 of the container without using any special tool.

As particularly clearly shown in FIG. 2, furthermore, it is desired that the skirt portion 6 is provided with a plurality of slits 14 maintaining a distance in the circumferential direction, the slits 14 upwardly extending in the axial direction from the lower ends thereof. Upon providing the slits 14, the skirt portion 6 can be outwardly expanded more easily enabling the cap body 2 to be more easily removed from the mouth 50 of the container.

It is desired that the slits 14 have their upper ends which are located higher than the protrusion 13 from the standpoint of easily removing the cap body 2 from the mouth 50 of the container.

The above-mentioned bridge portions 17 and the cut surfaces 19 can be easily formed by, producing a unitary molded article of the cap body 2 and the ring-like member 4 with integrally molding each as injection molding, compression molding or the like and, then, cutting the molded article by using a cutter or the like in a manner to leave the bridge portions 17.

Figure 3:
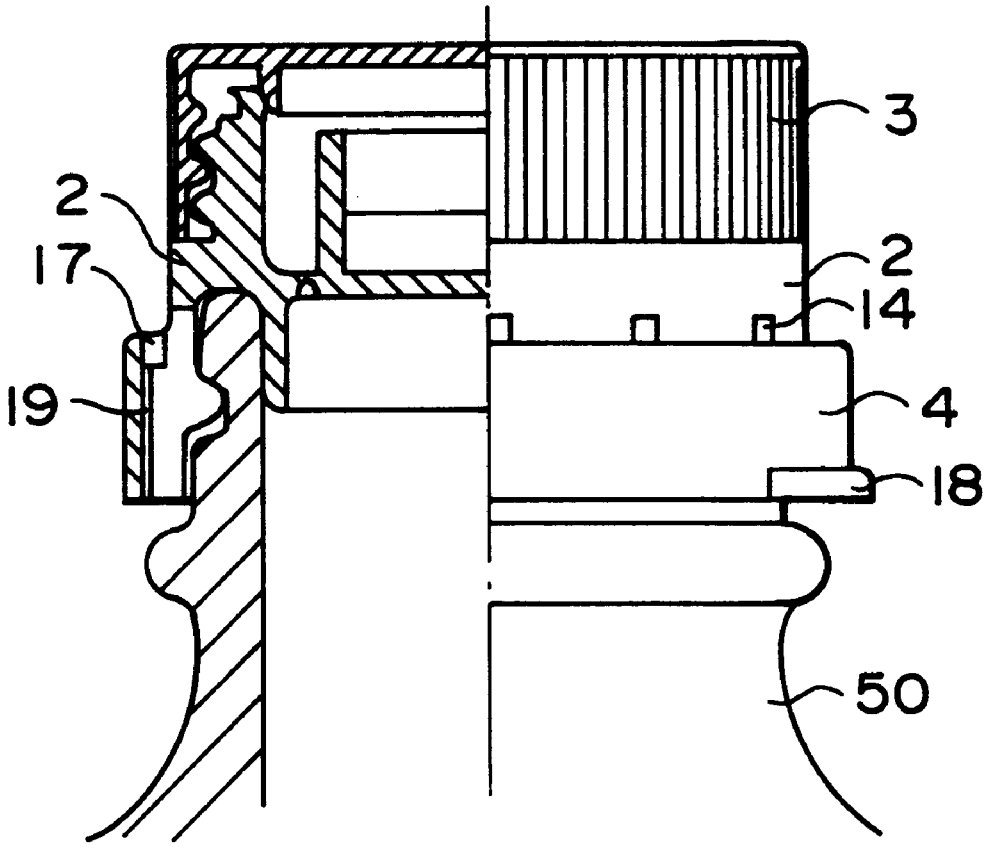
FIG. 3 is a side view illustrating, half in cross section, a cap according to another embodiment of the present invention.
Figure 4:
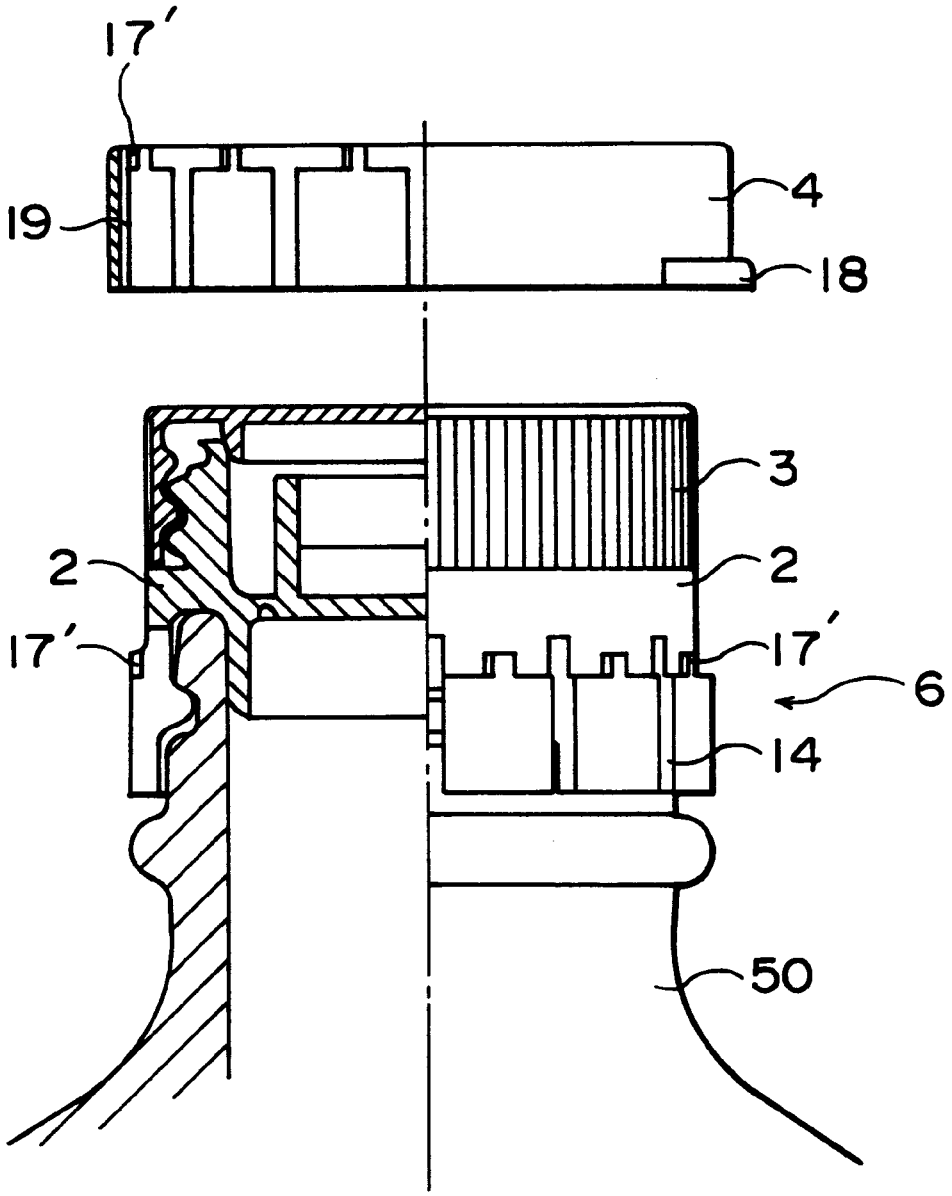
FIG. 4 is a side view illustrating, half in cross section, a state where a ring-like member is removed from the cap of FIG. 3.

In FIGS. 1 and 2, the bridge portions 17 are formed at the lower ends of the cut surfaces 19. However, the bridge portions 17 can be formed at the upper ends of the cut surfaces 19. FIG. 3 illustrates a cap having the bridge portions 17 formed at the upper ends of the cut surfaces 19, and FIG. 4 illustrates a state where the ring-like member is removed from the cap of FIG. 3.

When the bridge portions 17 are formed at positions shown in FIGS. 1 and 2, the cut surface 19 is formed by cutting from the upper direction. When the bridge portions 17 are formed at positions shown in FIGS. 3 and 4, the cut surface 19 is formed by cutting from the lower direction.

Figure 5:
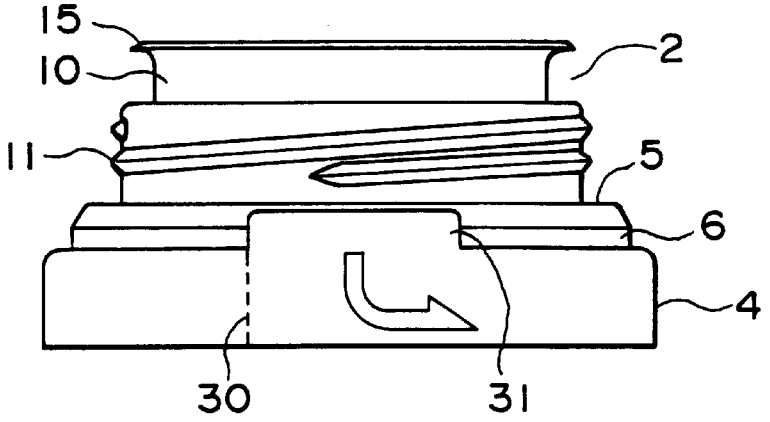
FIG. 5 is a side view illustrating a cap body of a cap according to a further embodiment of the present invention.

According to the present invention, the design can be changed in various other ways in addition to those shown in FIGS. 1 to 4. For example, the ring-like member 4 may be provided with a weakened portion such as score instead of the tab 18, so as to be easily torn away. FIG. 5 is a side view of the cap body 2 equipped with the ring-like member 4 having such a weakened portion. As will be obvious from FIG. 5, the ring-like member 4 is provided with a score 30 extending from the lower end to the upper end thereof, and a protruded piece 31 for tearing is formed to be continuous to the score 30. Upon grabbing the protruded piece 31 to break the score 30 and pulling out the ring-like member 4 that is turn, it is allowed to easily break the bridge portions 17 and to remove the ring-like member 4 from the cap body. In this embodiment, a notch may be formed at the upper end or the lower end of the score 30 instead of forming the protruded piece 31.

In the embodiment of FIG. 1, furthermore, the upper closure is provided on the cap body relying upon the screw-engagement. However, the upper closure and the cap body may be provided together as a unitary structure relying upon the coupling by hinges.

Figure 6:
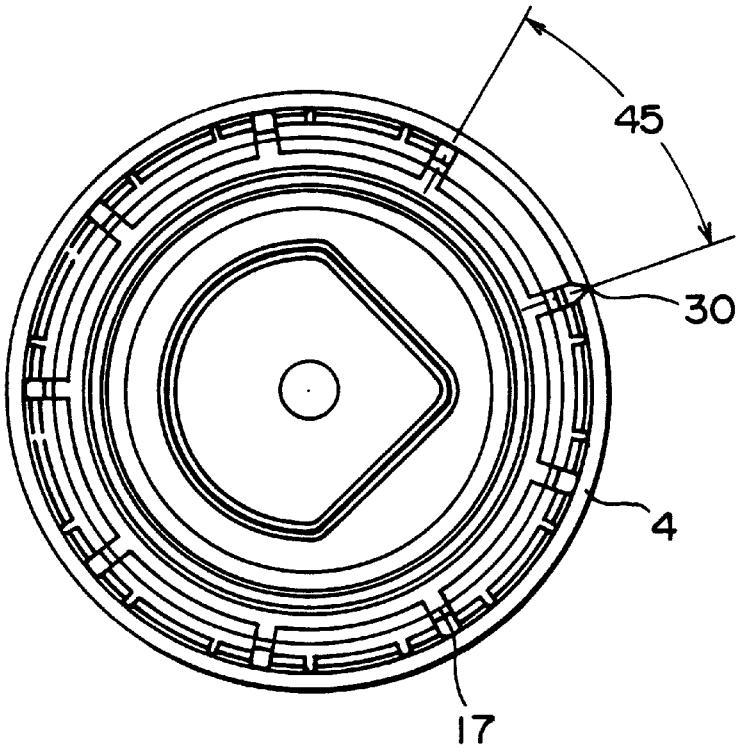
FIG. 6 is a bottom view of the cap of FIG. 5 which is provided with a coupling portion.

In the embodiment of FIG. 1, furthermore, the ring-like member 4 and the skirt portion 6 of the cap body are coupled together via breakable bridge portions 17 only. It is, however, also allowable to form a coupling portion that cannot be broken at, for example, the side opposite to the tab 18. In this case, the ring-like member 4 is raised with the coupling portion as a fulcrum, so that the skirt portion 6 is no longer tightened and the cap body 2 is easily removed from the mouth 50 of the container. The above-mentioned coupling portion can be easily formed by cutting leaving the bridge portions 17 and the coupling portion. FIG. 6 illustrates the cap of FIG. 5 which is provided with a coupling portion. In this embodiment, the coupling portion 45 is formed near the score 30. The coupling portion 45 is wide and cannot be broken.

The above-mentioned cap of the present invention can be easily removed by hand from the mouth of a container, and can be separated from the container at the time of disposal, yet offering excellent sealing and tamper-evidence.

What is claim is:

1. A cap comprising;

a cap body which comprises a top plate having a portion forming a port for pouring out the content, a skirt continuous to the peripheral portion of the top plate having a protrusion formed on the inner surface thereof to engage with the mouth of a container, and on the lower surface of the top plate, an inner ring extending downwardly with a distance from the skirt, said cap body being tightly fixed to the mouth of the container by fitting the mouth of the container in a space between the inner ring and the skirt so that the mouth is engaged with the protrusion provided in the skirt;

a ring-like member formed integrally with the cap body so as to cover at least the outer surface of a portion of the skirt on which the protrusion for engaging with the mouth of the container is provided; and an upper closure for covering the top plate of the cap body; wherein, the skirt and the ring-like member are connected through a plurality of breakable bridge portions spaced in the circumferential direction, the outer surface of the skirt and the inner surface of the ring-like member face each other via cut surfaces, and when the cap body is tightly fixed to the mouth of the container, the breakable bridge portions are not broken, and the outer surface of the skirt and the inner surface of the ring-like member are intimately contacted to each other at the cut surfaces.

2. A cap according to claim 1 wherein a port for pouring out the content is formed on the portion of the top plate.

3. A cap according to claim 1 wherein the bridge portions are positioned at the upper end of the cut surface.

4. A cap according to claim 1 wherein the bridge portions are positioned at the lower end of the cut surface.

5. A cap according to claim 1 wherein the skirt has a plurality of slits that are spaced in the circumferential direction and are extending from the lower end of the protrusion on the inner surface of the skirt.

6. A cap according to claim 1 wherein the upper closure is provided in screw engagement on the cap body.

7. A cap according to claim 1 wherein the upper closure is provided coupled by hinges on the cap body.

8. A cap according to claim 1 wherein the ring-like member has a weakened portion extending from the lower end to the upper end thereof.

9. A cap according to claim 8 wherein the ring-like member is provided with a protruded piece to tear the weakened portion.

10. A cap according to claim 8 wherein the ring-like member is provided with a notch to tear the weakened portion.

11. A cap according to claim 8 wherein the weakened portion is a score.

12. A cap according to claim 1 wherein the skirt and the ring-like member are connected together through the breakable bridge portions and a coupling portion that cannot be broken.

* * * * *